US005207579A

United States Patent [19]

Campagnuolo

[11] Patent Number: 5,207,579

[45] Date of Patent: May 4, 1993

[54] ANTIPERSONNEL TRAINING MINE

[75] Inventor: Carl J. Campagnuolo, Potomac, Md.

[73] Assignee: The United States of America as represented by the Secretary of the Army, Washington, D.C.

[21] Appl. No.: 708,253

[22] Filed: May 22, 1991

[51] Int. Cl.[5] ..... F41A 33/00

[52] U.S. Cl. ..... 434/11; 102/404; 340/326; 364/423; 273/372

[58] Field of Search ..... 434/11, 12, 13, 16, 434/21, 23; 102/401, 402, 404, 407, 410, 411, 201, 211, 432, 447; 364/423, 578; 273/310, 372; 340/435, 903, 943, 326, 385

[56] References Cited

U.S. PATENT DOCUMENTS 3,369,486 2/1968 Wrennstad et al. ..... 102/498
3,941,058 3/1976 Gawlick et al. ..... 102/210
4,319,426 3/1982 Lee ..... 446/401
4,409,899 10/1983 Owen et al. ..... 102/427 X
4,744,761 5/1988 Doerfel et al. ..... 273/371 X
4,823,401 4/1989 Gammarino et al. ..... 273/310 X
5,027,709 7/1991 Slagle ..... 434/11 X
5,074,793 12/1991 Hambric et al. ..... 434/11

*Primary Examiner*—Richard J. Apley
*Assistant Examiner*—Joe H. Cheng
*Attorney, Agent, or Firm*—Saul Elbaum; Frank J. Dynda

[57] ABSTRACT

An acoustic training mine simulator system for use with the pre-existing Multiple Integrated Laser Engagement System (MILES). The MILES, located on a target, responds to the acoustic output of said mine simulator upon simulated detonation. The MILES acoustic detection circuitry momentarily disconnects the MILES power supply from the rest of the MILES circuit, causing the MILES to generate an audible alarm indicating a target has been hit.

4 Claims, 10 Drawing Sheets

ANTIPERSONNEL TRAINING MINE

RIGHTS OF THE GOVERNMENT

The invention described herein may be manufactured, used and licensed by or for the United States Government for Governmental purposes without payment to us of any royalty thereon.

BACKGROUND OF THE INVENTION

1. Field of the Invention

This invention relates generally to military antipersonnel mine training devices which simulate battlefield explosive devices with bright flashes of light and buzzer type sounds and work in conjunction with systems which receive these sounds and which systems in turn provide an indication of the damage said battlefield explosive devices would have inflicted on targetted personnel and equipment.

2. Background of the Invention

This invention is used in systems that train soldiers for combat. The system that this invention is used in conjunction with is called the "Multiple Integrated Laser Engagement System" or (MILES). The MILES system has revolutionized the way in which armies train for combat. MILES has been fielded with armies of many nations throughout the free world and has become the International standard against which all other Tactical Engagement Systems (TES) are measured. Until this invention no antipersonnel training mine existed which could be used in a force on force training scenario, and be compatible with the MILES system. The specific mine that this invention was developed to simulate in conjunction with the MILES system is called an M16 antipersonnel mine, also called a Bouncing Betty or Tomato Can Mine.

The actual M16 series mine is functioned by either a 3 to 15 pound pull on a trip wire or lanyard or by a force of 8 to 45 pounds on one or more of several prongs protruding from the top of the M16 fuze. This pull or push releases a firing pin which strikes a primer which ignites a fuze delay charge. The fuze delay allows time for persons stepping on the prongs to move from directly above the mine. The fuze delay ignites a relay charge which ignites a fuze igniter charge. The fuze igniter charge ignites a mine propelling charge which projects the shell body upward and at the same time ignites a detonator delay charge. The detonator delay charge burns through and initiates a detonator which explodes boosters which explode a bursting charge about one meter above the ground. The M16 training mine of this invention functions with the MILES system by popping up when actuated, flashing a bright light, and utilizing a fixed frequency buzzer to produce acoustic waves which are picked up by microphones in a MILES harness worn by soldiers closeby in battlefield training conditions. One embodiment of this invention includes a time delay to simulate the fuze delay in the actual M16 antipersonnel mine.

The present existing MILES system contains a feature which is intended to sense the removal and replacement of batteries used to power the MILES equipment carried by the soldier. When a soldier removes and then replaces a battery in his MILES harness, the harness emits an audio alarm indicating the soldier has been hit by some weapon. Circuitry in the MILES harness which picks up the acoustic signal emitted by the buzzer in this invention processes the acoustic signal and uses the processed signal to activate a switch which removes the MILES harness battery from the harness circuitry. When the buzzer in the mine simulator stops, the circuitry in the MILES harness senses this and electronically places the battery back into the circuit of the MILES harness. This action causes the alarm in the MILES system to trigger indicating that a hit has taken place. A special feature presently incorporated in the MILES provides for an audible alarm to be activated upon removal and reinsertion of the MILES power source. This feature prevents a targetted soldier from rendering the MILES harmless by deactivating said soldier's MILES receiver during simulated combat, because when the power source or battery is reinserted an audible alarm is activated. Consequently, by electronically momentarily removing the MILES power source from the MILES circuit for a time and then reinserting it back into the MILES circuit, the MILES mine simulator system is able to utilize this "off and on" action as a "hit" indication. This operation is performed when MILES receiver circuitry detects an acoustic signal of sufficient amplitude and duration. This acoustic signal can even be a coded acoustic signal. A means for detecting the acoustic signal, for example a microphone, is located on each target which has been outfitted with a MILES. Targets can be vehicles, soldiers, buildings, etc. The microphone that detects the acoustic signal generated by the mine simulator is connected to MILES receiver and identification circuitry. The output of the receiver is used as signal to momentarily remove the MILES power source from the rest of the MILES circuit. This results in the MILES audible alarm being activated.

Accordingly, it is an object of this invention to provide a reuseable M16 antipersonnel mine simulator system which is compatible with a MILES system worn during training exercises by a soldier, or soldiers.

It is another object of this invention to provide a mine simulator system which simulates the M16 or Bouncing Betty, Tomato Can Mines by popping up above the ground when stepped on or when a trip wire/lanyard attached to the mine is tripped.

It is yet another object of this invention to provide a mine simulator that utilizes more than one type of release mechanism and functions with the pre-existing MILES system.

It is a further object of this invention to provide a mine simulator circuit for functioning a buzzer and flashbulb in the mine simulator upon actuation or "popping" and for keeping the buzzer on for a period of time sufficient to activate the MILES system equipment worn by the soldier or soldiers to indicate a "hit".

SUMMARY

Briefly, the foregoing and other objects are achieved by a harmless, reusable mine simulator system training device resembling the M16 type of antipersonnel mine usually referred to as a Bouncing Betty or Tomato Can mine. Utilizing pressure actuation or trip-wire/lanyard functioning the mine simulator functions when a release mechanism actuates allowing an inner housing to pop up. As the inner housing pops up, a switch is activated causing an electrical circuit to fire a flash bulb. At the same time a buzzer controlled by a timing circuit functions for a short but controlled period of time. This "ON" and then "OFF" functioning of the buzzer causes the sensors in the MILES system worn by the soldier or other targets to activate indicating a "hit".

BRIEF DESCRIPTION OF THE DRAWINGS

A better understanding of the invention will be obtained when the following detailed description of the invention is considered in connection with the accompanying drawings in which.

DETAILED DESCRIPTION OF THE INVENTION

Figure 1:
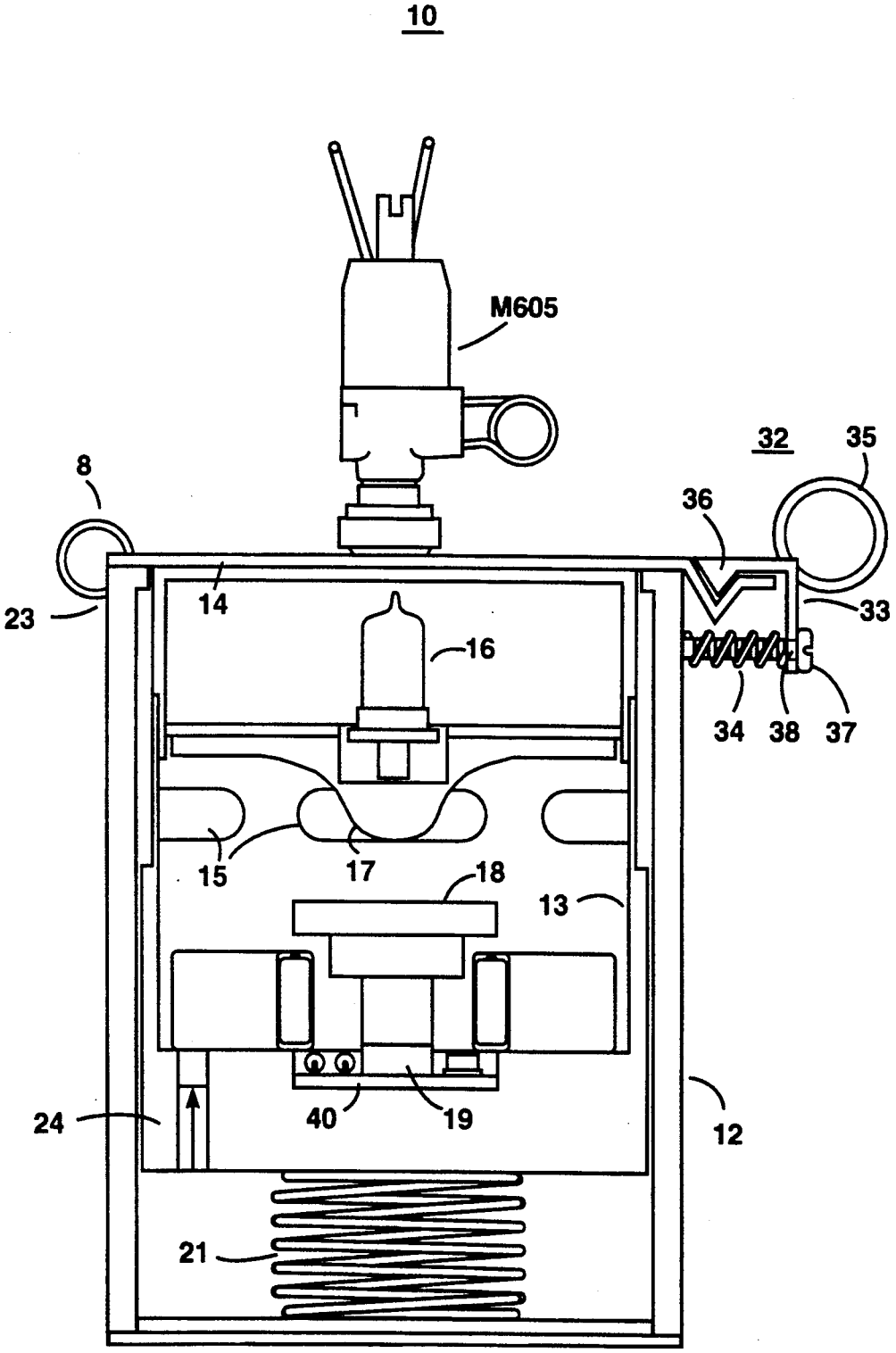
FIG. 1 is a picture of the mine simulator in the emplaced or down mode.
Figure 1A:
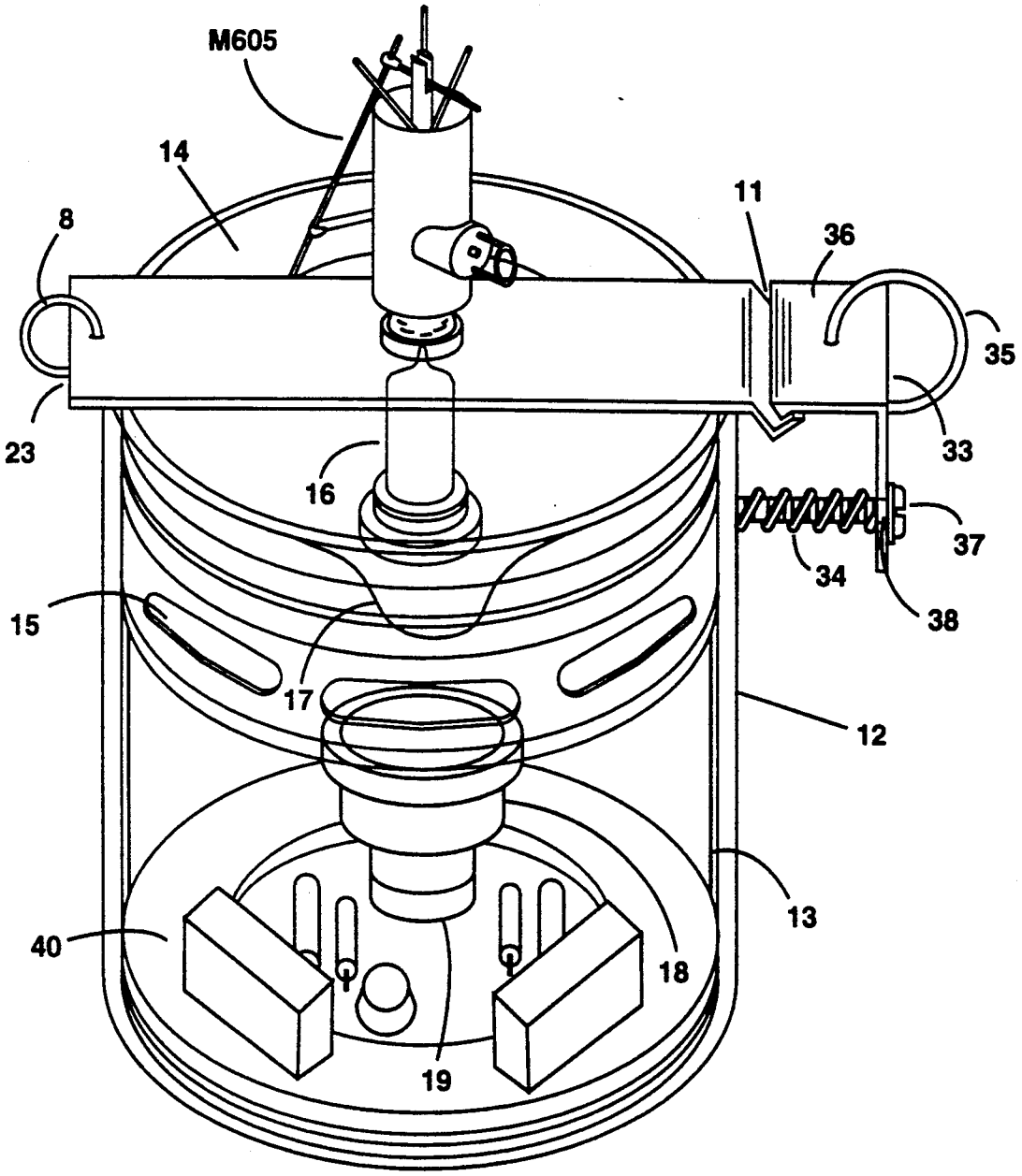
FIG. 1A is a three dimensional view of the mine simulator shown in FIG. 1.
Figure 2:
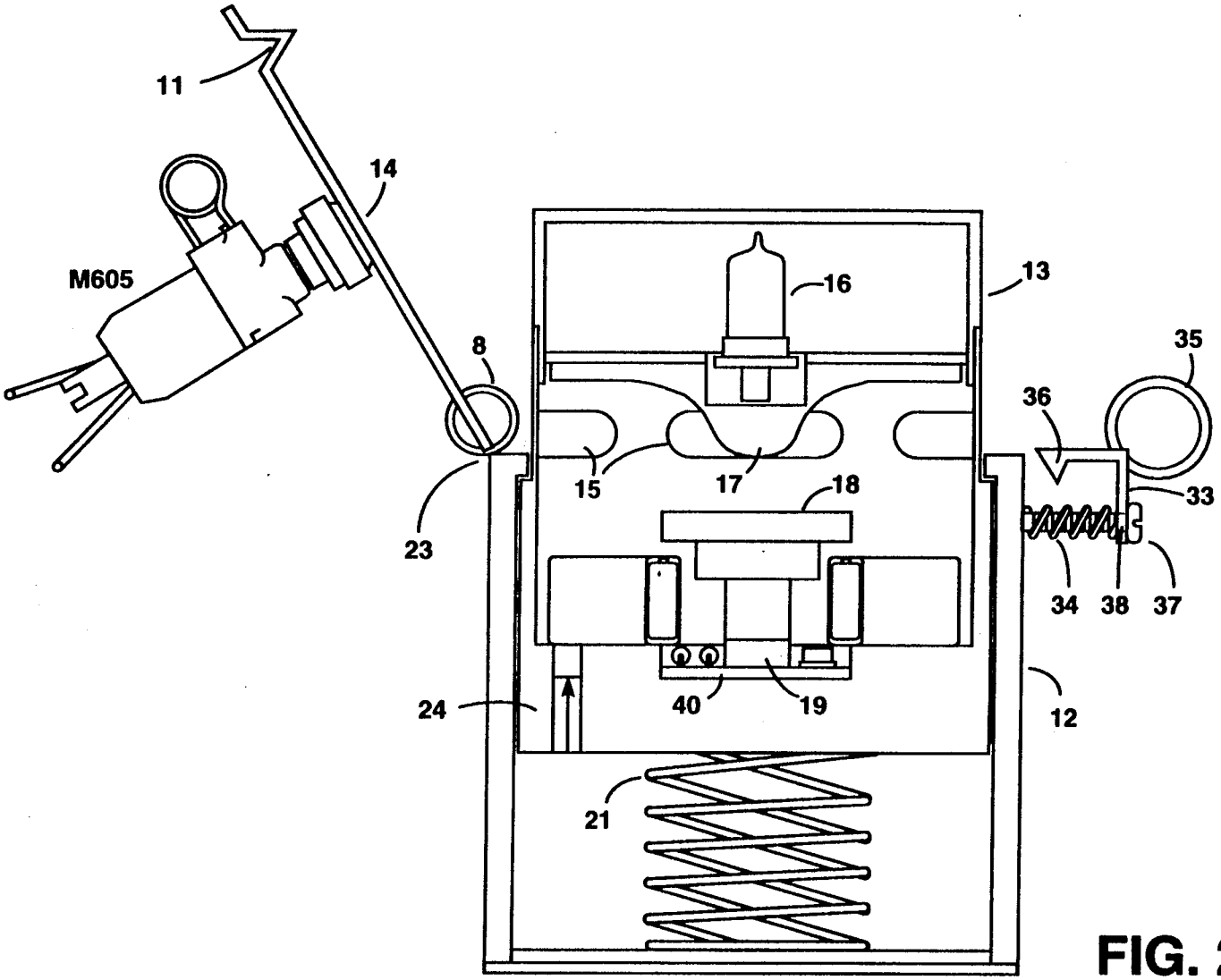
FIG. 2 is a sketch of the mine simulator in the extended or functioned mode.

Referring now to FIGS. 1, 1A, and 2, it may be seen that an inner can shaped housing 13 resides inside of an outer can shaped housing 12 when the mine simulator 10 is in the down mode and the simulated fuze lid 14 is latched by the latching and releasing mechanism 32. In the down mode, spring 21 is compressed by the inner housing 13, spring 21 tends to force inner housing 13 up and thereby exerts force against the fuze lid 14. In this embodiment fuze lid 14 tends to pivot around pivot point 23. This pivoting is prevented by the latching and releasing mechanism 32. fuze lid 14 can accomodate a variety of release mechanisms; in this embodiment it consists of a heavy wire with a simulated M605 fuze attached on top to look realistic. Said lid 14 has a groove 11 at one end to cooperate with the release mechanism 32, and a lid loop 8 at the other end that links with said lid 14 to the outer housing 12. Fuze lid groove 11 accepts a lip 36 on catcher 33 of the release mechanism 32. In order to latch the mine 10 in the down mode, the inner housing 13 is held down and the catcher 33 is forced against the pressure of catcher spring 34 and the lip 36 is inserted into lid groove 11 which action latches the mechanism 32. Fuze lid loop 8 links with the outer housing 12 to comprise said pivot point 23. Catcher 33 has a release loop 35 attached to it which can loosely support a tripping wire or lanyard threaded through it. Catcher 33 containing a hole 38 is rotatably and pivotally mounted to outer housing 12 by means of a bolt 37 inserted through said hole 38 and a helically wound catcher spring 34 and then attached to outer housing 12 by conventional methods. This allows the catcher 33 to either rotate or pull off of said groove 11 on fuze lid 14, thereby activating said mine 10.

Figure 3:
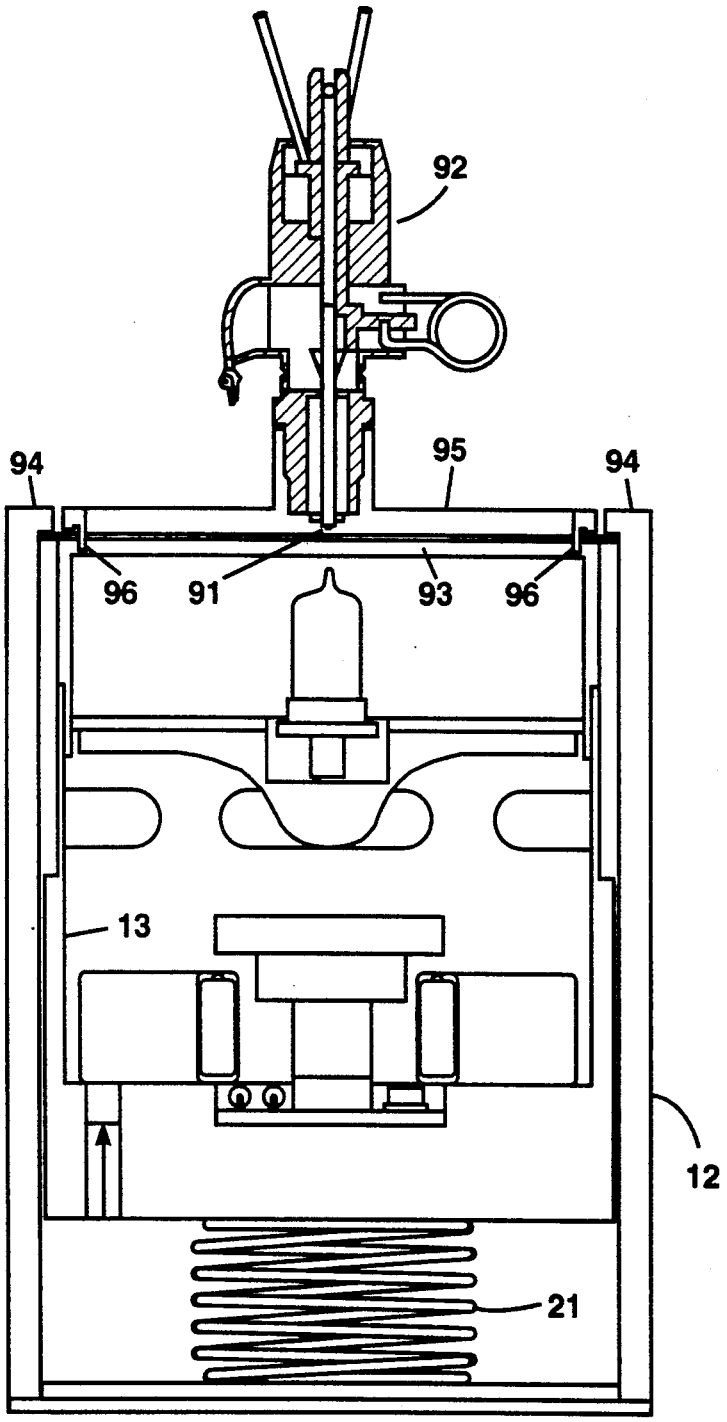
FIG. 3 is a detailed illustration of a leaf-spring release mechanism for the mine simulator.
Figure 3A:
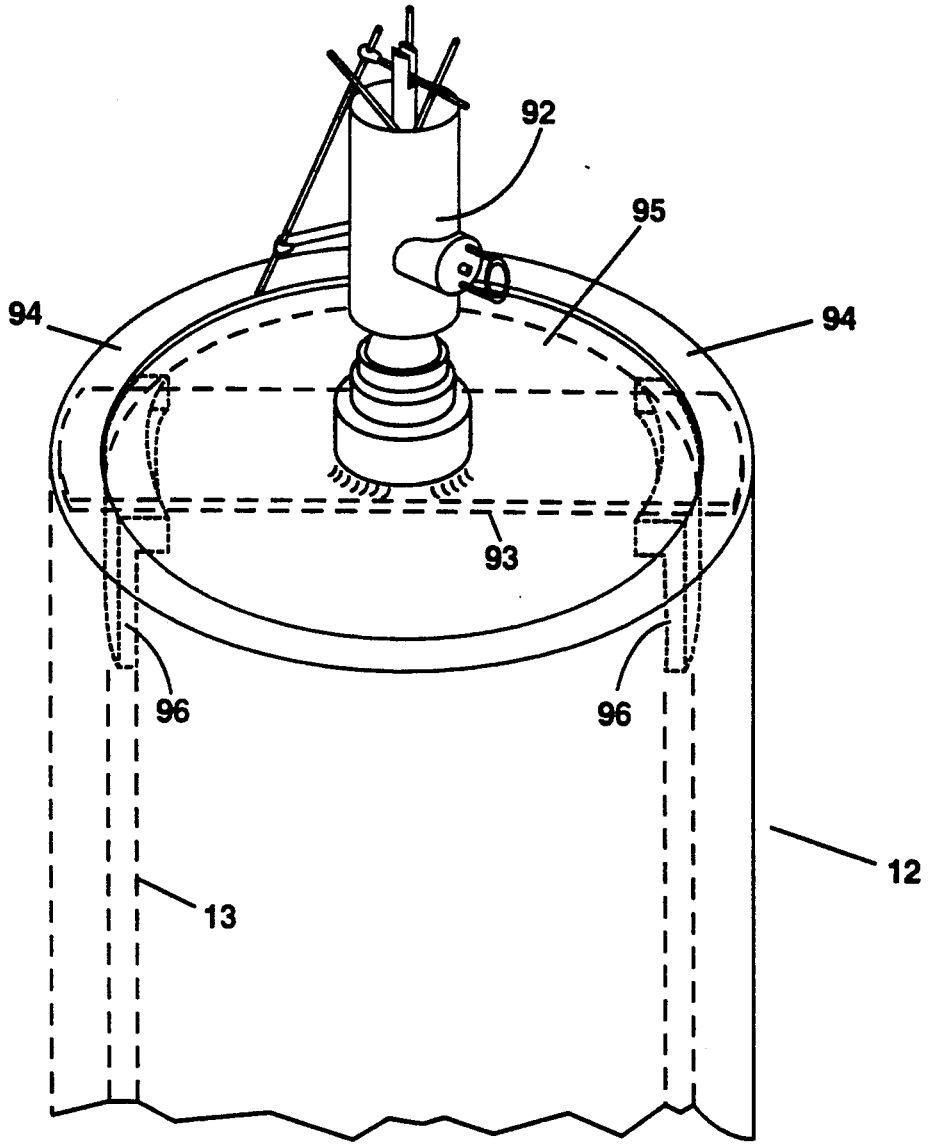
FIG. 3A is a three dimensional view of the release mechanism shown in FIG. 3.
Figure 5:
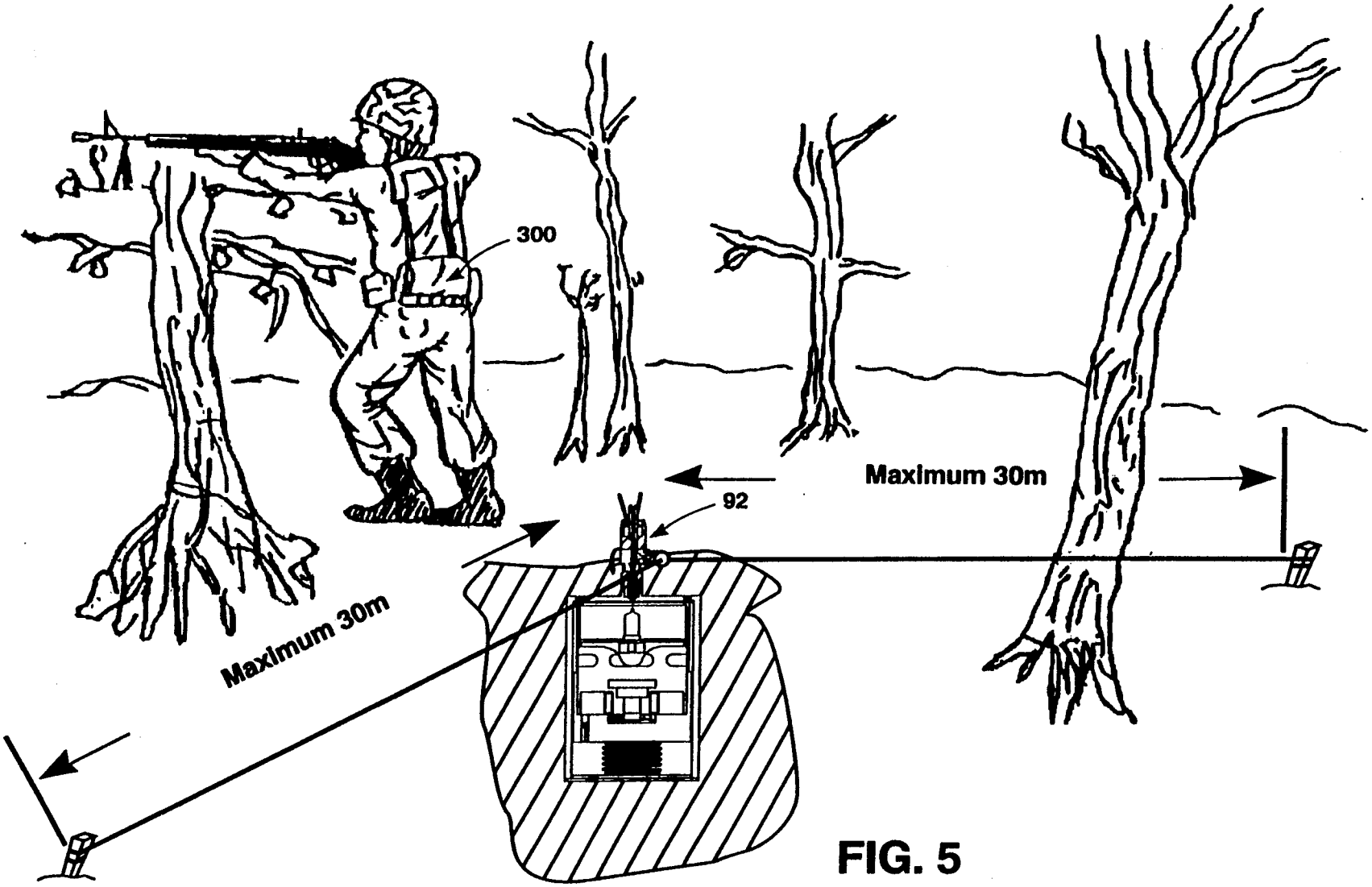
FIG. 5 is an illustration of the mine simulator set up with a trip-wire which simulates the trip-wire setup of the real M16 Bouncing Betty antipersonnel mine.

The inner housing 13 pops out of the outer housing 12 when the release mechanism 32 is activated by stepping on top of the training mine 10. This applies pressure on top of the inner housing 13 which compresses spring 21 which allows the catcher spring 34 of the release mechanism to push the catcher 33 away from the groove 11 in the fuze lid 14 allowing the inner housing 13 to pop up. FIG. 5 shows a trip-wire/lanyard setup utilizing the mine simulator with a release mechanism as shown in FIGS. 3 AND 3A. FIG. 5 also shows a soldier wearing a MILES receiver or target component 300. The trip-wire or lanyard (not numbered) in FIG. 5 is threaded through the pull ring on the modified M605 fuze 92. In the manner shown in FIG. 5 the mine simulator 10 can also be activated by threading a wire through a catcher loop 35 mounted on catcher 33, connecting both ends of the wire away from the mine simulator 10 to stakes in the ground in a vee fashion and then yanking the wire to simulate a soldier tripping over it. This yanking action either pulls catcher 33 away from the groove in the fuze lid 14, and/or rotates catcher 33 off of the groove in the fuze lid 14, thereby activating the release mechanism.

As shown in FIG. 2, inner casing 13 contains flash bulb 16, sound deflector 17, sound horn 18, buzzer 19, electrical circuit 40, and switch 24.

The operation of the electrical circuit initiates when the release mechanism 32 is tripped by one of the methods described above. As inner housing 12 moves upward, switch 24 activates initiating an electrical circuit 40 that simultaneously flashes flash bulb 16 and turns on buzzer 19. The sound waves emitted by buzzer 19 are amplified by horn 18 and then deflected by sound deflector 17 to radiate outward through numerous apertures 15 of inner housing 13. Buzzer 19 stays on for about three seconds, propagates about thirty meters and causes the MILES system, of soldiers who are within that radius, to activate indicating a "hit".

Figure 4:
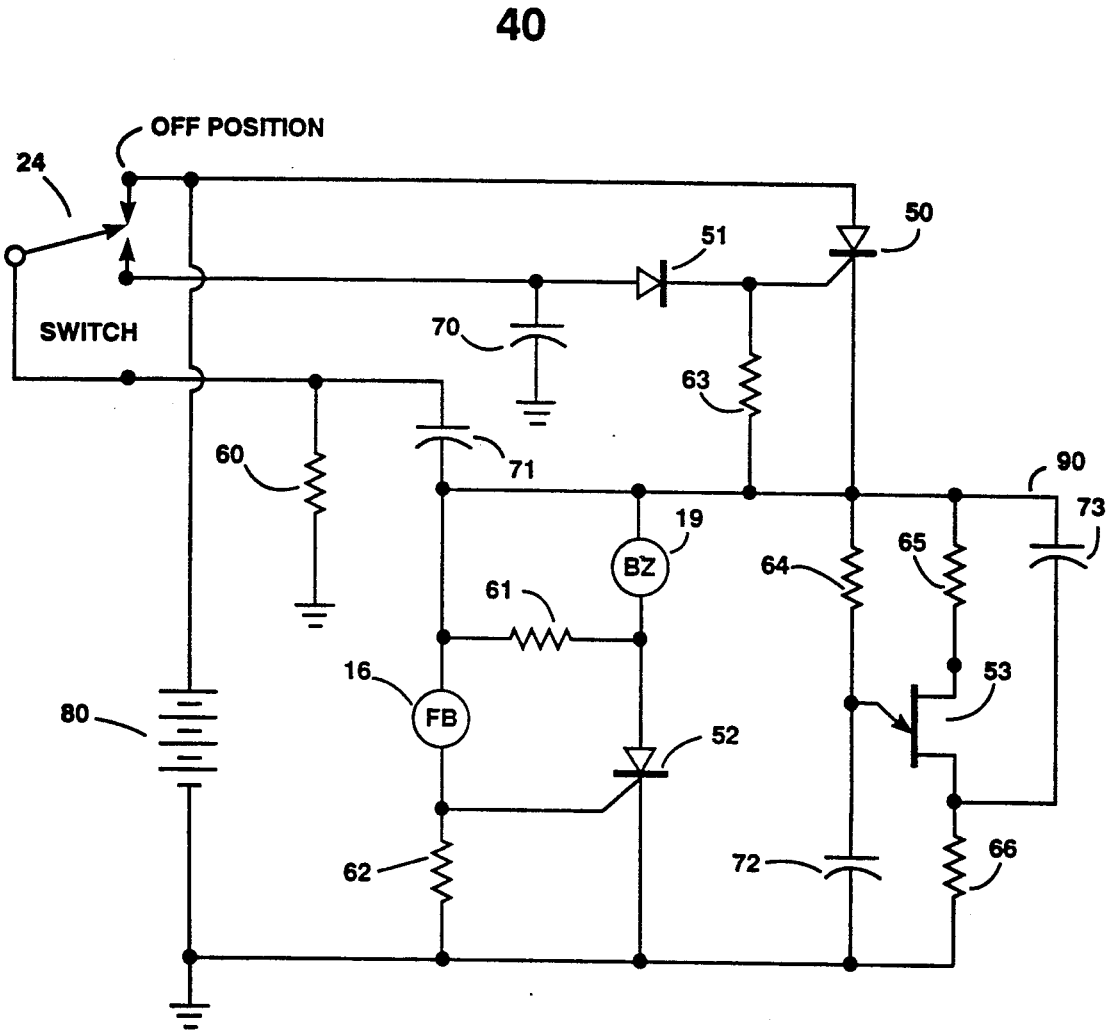
FIG. 4 is a diagram of the electrical circuit in the mine simulator that controls the flashbulb and the acoustic sound generator.

The details of electrical circuit 40 are shown in FIG. 4. Before switch 24 activates, capacitor 71 has been charged to battery 80 voltage. This charging takes place through flashbulb 16, and resistor 62. Upon activation, switch 24 places the charged capacitor 71 across the trigger circuit of SCR 50 which comprises capacitor 70, diode 51, and resistor 63. Said charged capacitor 71 then discharges through the said trigger circuit and gate of SCR 50 thereby turning SCR 50 on. When SCR 50 turns on, flashbulb 16 fires, a gate signal is applied to SCR 52 by the voltage produced across resistor 62, and SCR 52 turns on thereby turning on buzzer 19. At the same time the RC time constant circuit consisting of resistor 64 and capacitor 72 starts charging capacitor 72. After about three seconds unijunction transistor 53 turns on thereby discharging capacitor 72 through resistor 66 creating a pulse voltage across resistor 66 which adds to the voltage across capacitor 73. At this time the voltage at point 90 in the circuit is about double the battery voltage and thereby effectively turns off SCR 50. This said action enables the buzzer to function for about three seconds enabling the sound thus produced to actuate any MILES equipment in the effective area of the sound.

The function of resistor 60 is to drain capacitor 71 to prevent inadvertant starting of the circuit. Resistor 61 provides a path for sufficient current for SCR 52 to keep it on. It has been found that the following types and values of components have worked effectively:

Battery 80, 18 volts-consisting of two nine volt alkalines;

SCR 50 and 52, MCR 102;
Unijunction 53, 2N2646;
Diode 51, 1N914;
Resistors 62, 61, 65, and 66, 100 ohms;
Resistor 60, 10,000 ohms;
Resistor 63, 1000 ohms;
Resistor 64, 240,000 ohms;
Capacitor 70, 0.01 uf;
Capacitor 71, 0.22 uf;
Capacitor 72, and 73, 10 uf;
Buzzer 19, Archer 273-074; and
Flashbulb 16, Sylvania AG1B-blue dot.

Figure 4A:
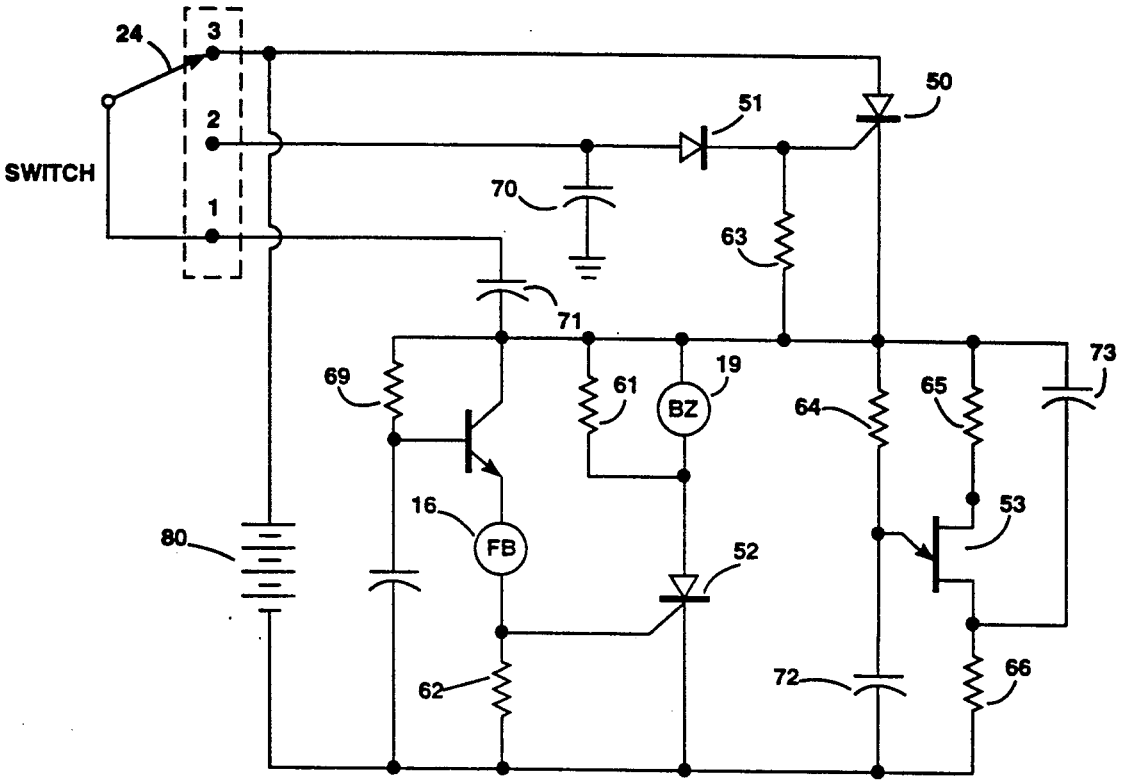
FIG. 4A is the schematic of FIG. 4 with an added time delay.

FIG. 4A is a schematic of the same circuit as in FIG. 4 with the addition of a time delay circuit consisting of resistor 69, capacitor 76, and transistor 77. This time delay is provided to replicate the delay before operation found in the real M16 mine. In this circuit, operation of the flashbulb 16 and buzzer 19 commences when sufficient voltage is developed at the base of transistor 77 to turn transistor 77 on.

FIG. 3 and 3A show an embodiment of a leaf-spring release mechanism utilizing a modified M605 fuze 92, modified by removing the portion below the firing pin 91, which included the pyrotechnics which are not needed. Inner housing 13 contains all of the electronic components described in FIGS. 1, 1A, 2, and 4 but not shown in FIG. 3. Leaf-spring 93 is loosely suspended from a inner housing top 95 by two supports 96 which are firmly attached to said housing top 95. Said housing top is firmly attached to said inner housing 13. Inner housing 13 has two slots 97 which allow leaf-spring 93 to protrude and seat against the rim 94 against the force of spring 21. When the fuze 92 is actuated, as described earlier, the firing pin 91 plunges downward about a half inch striking leaf-spring 93 in the center and bowing the leaf-spring so as to pull in the ends thereby unlatching the inner casing 13 from the rim 94 of the outer casing 12, and allowing can spring 21 to push the inner casing 13 upward with the attendant consequences as described earlier. Leaf-spring 93 is a narrow rectangular strip of a suitable material typically metal or plastic.

Figure 6:
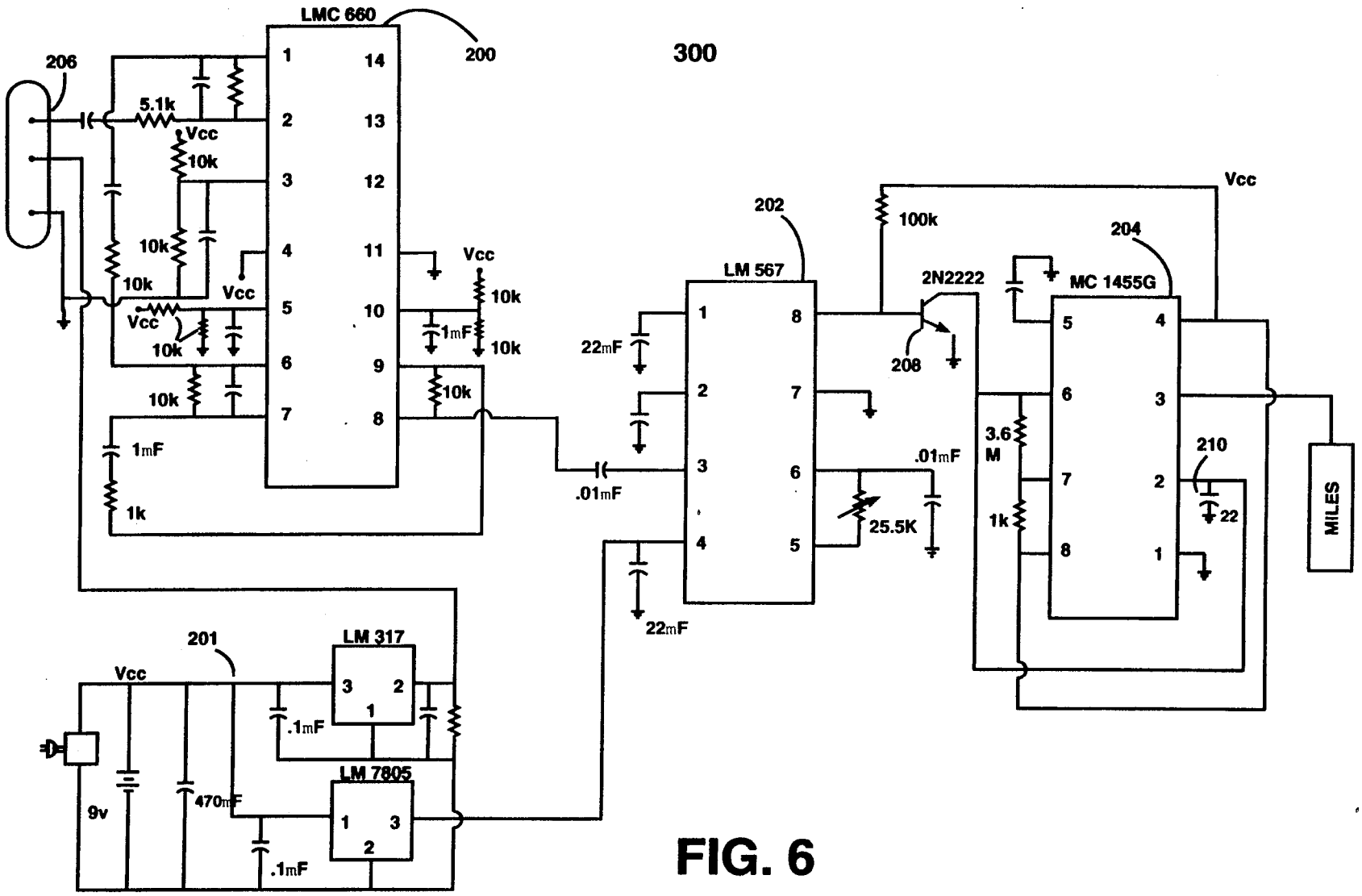
FIG. 6 shows an electrical schematic diagram of a basic embodiment of the receiver circuitry according to an aspect of the invention.

FIG. 6 shows a schematic of the receiver or (target component) 300 which includes MILES interface circuitry which comprises a quad operational amplifier (LMC 660) 200, a phase lock loop (LM 567) 202, a timer circuit (MC 1455G) 204, a microphone 206 and various discrete components. A rechargeable power section 201 provides voltage to the applicable circutry. All of the functions performed by the receiver circuitry are accomplished using conventional, off-the-shelf components, with values shown as merely exemplary of an operational device.

When an acoustic signal is received from an acoustic mine simulator, such as the mine simulator previously described, said acoustic signal is detected by said microphone 206. A conventional hearing aid may be used as the microphone 206. The output of said microphone 206 is fed to the quad amplifier 200. The quad amplifier 200 is configured as two cascaded bandpass filters followed by an active high pass filter. The filters are frequency adjusted to center around the emitting frequency of the acoustic mine simulator and to amplify the microphone output. The output (pin 8) of the quad amplifier 200 is fed to the input (pin 3) of phase lock loop 202. The phase lock loop 202 is configured as a narrow band tone detector. The output (pin 8) of the phase lock loop 202 goes low when a signal of the proper frequency is presented to the input (pin 3) of the phase lock loop 202. The output (pin 8) of the phase lock loop going low causes the base on transistor 208 to go low which allows capacitor 210 to charge. If the output (pin 8) of the phase lock loop stays low long enough for capacitor 210 to charge beyond a set threshhold, power supplied (by pin 3) to the MILES through timer 204 is removed. The MILES is thus supplied power through the output of timer 204 in place of the normal battery in the MILES. Power remains removed from the MILES until the acoustic signal is no longer received from the acoustic mine simulator. When the acoustic signal is no longer being received, power is restored to the MILES and its internal audible alarm is activated indicating a "hit" has taken place. This is the target component responsive to an acoustic signal for actuating an alarm.

Figure 7:
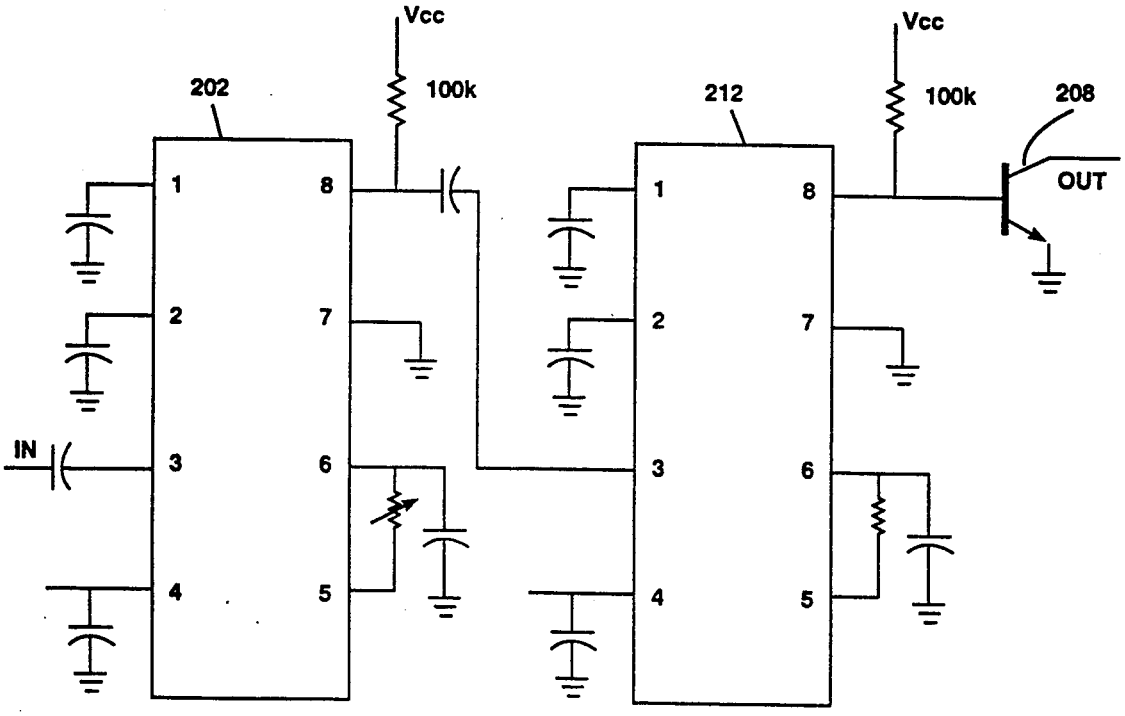
FIG. 7 shows a partial electrical schematic diagram of decoding circuitry as added to the circuitry as shown in FIG. 6.

Another embodiment of the present invention is shown in FIG. 7, and includes an additional phase lock loop 212. An additional phase lock loop provides for receiving coded pulse modulated signals transmitted from the acoustic mine simulator. Only that portion of the circuit centered around the additional circuitry is shown. The remaining portion is as shown in FIG. 6.

The circuitry preceeding the input (pin 3) of phase lock loop 202 remains the same as shown in FIG. 6. The input signal comes from the quad amplifier 200. The output (pin 8) of phase lock loop 202 goes high and low at the pulse modulation rate of the acoustic mine simulator. A second phase lock loop 212 is inserted between phase lock loop 202 and transistor 208 and acts as a tone decoder that only locks on to a signal at the modulation frequency. The output (pin 8) of phase lock loop 212 goes low when an acoustic signal of the right frequency and modulation rate is received. The remaining portion of the circuit is identical and operates as that shown in FIG. 6.

Having described this invention, it should be apparent to one skilled in the art that the particular elements of this invention may be changed, without departing from its inventive concept. This invention should not be restricted to its disclosed embodiment but rather should be viewed by the intent and scope of the following claims.

What is claimed is:

1. A mine simulator system comprising an inground component for emitting an acoustic signal, a means in said inground component for activating said acoustic signal, a target component comprising a means for detecting an acoustic signal, a means responsive to said detecting means for identifying said acoustic signal, and a means responsive to said identifying means for activating a pre-existing multiple integrated laser engagement systems (MILES) audible alarm system upon identification of said acoustic signal wherein said inground component comprises:

an outer housing, an inner housing movable with respect to said outer housing, means for moving said inner housing in relation to said outer housing, a release mechanism to control movement of said inner housing with respect to said outer housing, and a means to produce said acoustic signal upon activation of said release mechanism.

2. A mine simulator system as in claim 1 in which said means for moving said inner housing comprises a first spring means.

3. A mine simulator system as in claim 1 wherein said release mechanism comprises:

a flexible leaf spring, a inner housing top containing two slots from which the ends of said flexible leaf spring loosely protrude and bear against an outer housing rim when said inner housing is constrained within said outer housing in a latched mode and wherein said inner housing top is rigidly attached to said inner housing, and a pre-existing M605 mine fuze, modified to remove all pyrotechnics, mounted to said inner housing top and wherein a firing pin of said M605 mine fuze bears against the center of said flexible leaf spring, whereby triggering of said standard mine fuze forces said firing pin downward which pushes said leaf spring downward which causes the ends of said leaf spring to be drawn into said inner housing thereby unlatching and releasing said inner housing from said outer housing allowing said inner housing to move upward.

4. A mine simulator system as in claim 3 wherein said inground component comprises a means for emitting visible light.

* * * * *